United States Patent [19]

Johnson et al.

[11] 4,288,887

[45] Sep. 15, 1981

[54] FRAME CORNER CONNECTOR

[75] Inventors: Larry K. Johnson; Kenneth L. Gates, both of Sterling, Ill.

[73] Assignee: Lawrence Brothers, Inc., Sterling, Ill.

[21] Appl. No.: 95,421

[22] Filed: Nov. 19, 1979

[51] Int. Cl.[3] ..... A47N 15/00; E05D 13/02

[52] U.S. Cl. ..... 16/105; 403/231; 16/87 R; 49/409

[58] Field of Search ..... 403/231; 160/199, 206; 49/404, 409; 16/87 R, 105

[56] References Cited

U.S. PATENT DOCUMENTS

| | | | |
|---|---|---|---|
| 1,820,206 | 8/1931 | Wilson | 403/231 |
| 3,058,173 | 10/1962 | Brydolf | 49/411 |
| 3,261,129 | 7/1966 | Brydolf | 49/411 |
| 3,450,426 | 6/1969 | Kellems | 403/231 |
| 3,879,912 | 4/1975 | Cox | 49/409 X |
| 3,914,062 | 10/1975 | Heininger | 403/231 |

*Primary Examiner*—Wayne L. Shedd

*Attorney, Agent, or Firm*—Trexler, Bushnell & Wolters, Ltd.

[57] ABSTRACT

A corner connector arrangement is disclosed for use in joining like vertical and horizontal frame sections for use in framing panels in the assembly of sliding doors. The connector, comprised of two clamp sections and having protrusions bearing against the frame sections, is easily attached to any corner thereof, securing said frame section with a clamping engagement.

13 Claims, 8 Drawing Figures

FRAME CORNER CONNECTOR

BACKGROUND OF THE INVENTION

The present invention relates in general to a frame for a door panel and, more particularly, to hardware for framing door panels in the assembly of sliding doors, although it will be understood that other applications are possible.

Panel frame hardware heretofore employed has been of the type wherein a rectangular panel frame includes vertical stiles and horizontal rails of different cross sectional configuration and connectors in the corners of the frame which secure the respective stiles and rails. Hardware as disclosed in the patent to Brydolf U.S. Pat. No. 3,058,173, is typical of the prior art designs, and shows stiles and rails having front channels facing inwardly and adapted to receive panel edges therein. A rear flange of the rail is provided with lugs which secure the rail to the corner connector, and a rear flange of the stile is provided with a hole to secure said stile to the corner connector by means of the sheet metal screw. In a second Brydolf et al patent, U.S. Pat. No. 3,261,129, dissimilar stiles and rails are secured by striking or deforming portions of the rails into suitable holes formed in the corner connector. U.S. Pat. No. 3,450,426 to Kellems shows a similar panel frame arrangement with projections and spring detents on the connectors which cooperate with preformed openings in the rail and stile member to secure the frame section corner joints.

These prior art assemblies each employ different securing means for the abutting stiles and rails, and the stiles and rails themselves are of different individual cross-sectional design. As the connectors are asymmetric and mirror images of each other, the connectors at adjacent corners of the frame are not interchangeable. Thus the construction of a complete frame requires two "left hand" and two "right hand" connectors. Also, as the cross-section of the stile and rail are different, each part must be tooled and fabricated in separate manufacturing operations, and care must be taken to properly package the correct member of "right handed" and "left handed" connectors.

During the aforementioned operations, the stiles and rails are provided with notches or apertures to accept snap-in type connectors. As these notches or apertures determine the placement of the corner connector and thus the size of the door, the prior art connectors have required the manufacturing and stocking of many predetermined lengths of stiles and rails to meet the need for different door sizes. Even though the installer could carry different factory pre-sized hardware, the need for custom-sized hardware could not be met.

In addition, prior art connectors often are inadequate due to their "snap fit" type of engagement where tightness depends upon tolerances. If proper tolerances are not met, the corner fit will have considerable movement and instability in the joint, or alternately, it might be impossible to attain assembly.

The present invention overcomes the disadvantages of the prior art connectors and joints and presents other novel features not heretofore considered. Briefly, the present joint provides for rails and stiles having an identical cross section which yields not only additional strength, but also avoids the duplication of tooling and fabrication necessary to produce stiles and rails of differing design. Further, the present connector, in cooperation with these stiles and rails, is symmetrical about its vertical axis, which allows the four corners of the panel frame to be secured by identical connectors and eliminating the need for the manufacturing of mirror image hardware, viz., right and left handed connectors.

As hereinafter described, the panel hardware of the present invention does not coact with preformed apertures or notches in the frames. Thus, the installer can easily shorten the length of a stile or rail to adapt the dimensions of the frame to fit any door size, as well as accommodate tolerance variations that may be encountered. In addition, as the corners are connected by clamp sections using threaded fasteners rather than a "snap fit" type of engagement, the present invention yields a joint of superior strength, stability, and durability.

The foregoing advantages, together with other advantages, features and results thereof may be attained with the preferred embodiment of the invention described in detail hereinafter and illustrated in the accompanying drawings, in which:

DESCRIPTION OF THE ILLUSTRATED EMBODIMENT

Figure 1:
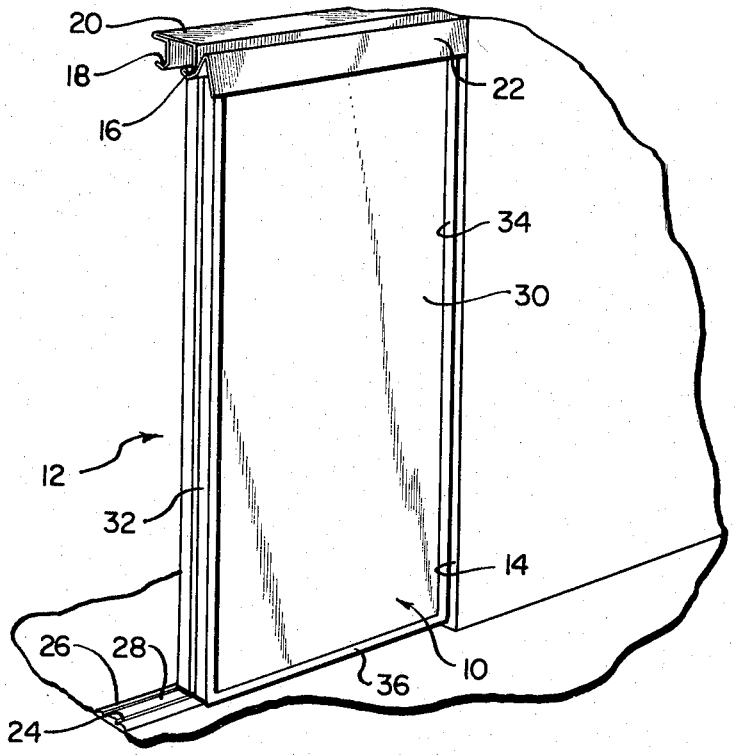
FIG. 1 is a front perspective view of a sliding door assembly according to the present invention.

Referring more particularly to the drawings, FIG. 1 shows by-passing sliding doors 10 and 12 installed in a doorway 14. The doors 10 and 12 are suspended from overhead channels 16 and 18 which are formed in a header track 20 as is known in the art. The header track 20 is generally of one-piece construction with a fascia portion 22 which conceals the suspending hardware, not shown. The lower edges of doors 10 and 12 are guided during sliding movement by channels 24 and 26 which are formed in a sill member 28. The hardware for the attachment of doors 10 and 12 to header track 20 and sill 28 is more fully described hereinafter.

Figure 2:
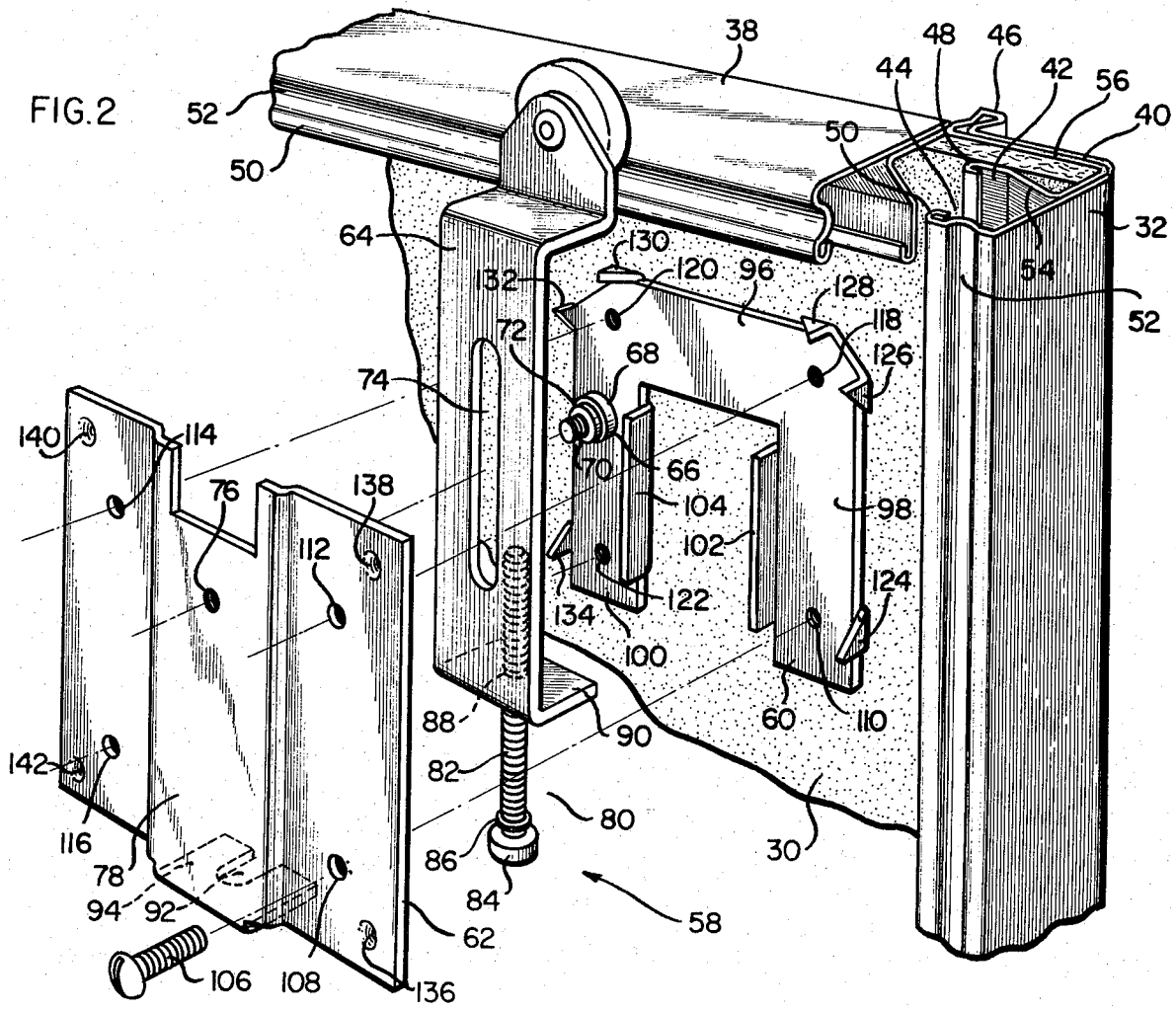
FIG. 2 is an exploded rear perspective view of the frame sections, top corner connector and hanging member in accordance with the present invention.

The door 10 is comprised of a panel 30 of suitable material such as wood, fiberboard or the like, enclosed by vertical frame stiles 32 and 34, a lower, horizontal frame rail 36, and an upper horizontal frame rail 38, not shown in FIG. 1, but visible in FIG. 2. Since door 12 is of similar design, only the construction of door 10 will be discussed in detail.

FIG. 2 shows the novel features of the present invention as embodied in a rear view of the door 10 of FIG.

1. As should be noted, the stile 32 and upper rail 38 are of identical cross-section, being generally E-shaped and including front, intermediate, and rear flanges 40, 42, and 44 as designated on the stile 32.

Each frame section is formed from a single piece of suitable material which is bent or formed into the shape shown in FIG. 2 where a double thickness of material is provided for front flange 40 and to economically form the three-flanged construction of the rails and stiles. Strength and rigidity for the sections are provided by lips 46, 48, and 50 which are formed along the free edges of flanges 40, 42, and 44. Intermediate flange 42 there is provided a converging section 54 which angles toward the front flange 40, rendering said flange 42 resilient to hold the edge of the panel 30 in a front channel 56 provided between flange 40 and 42.

It is to be understood that as all frame sections, viz., stiles 32 and 34 and rails 36 and 38 are of identical cross-sectional configuration, the description hereto set forth of frame stile 32 applies to the opposite frame stile 34 and to frame rails 36 and 38.

Stile 32 and upper rail 38 are secured to provide a corner joint by a novel corner connector, shown in an exploded view in FIG. 2 and designated generally 58. The corner connector 58 constructed of a suitable rigid material and is seen to be comprised of a front clamp section 60 and a rear clamp section 62. In addition, the corner connector 58 is adapted to accommodate a hanger member 64 to engage the overhead channel 16 as shown in FIG. 1 and more fully described hereinafter. The hanger member 64 is attached to rear clamp section 62 by means of fastener 66, which is fashioned to include enlarged head portion 68, threaded shank portion 70, and intermediate shoulder section 72. The fastener 66 is inserted through a channel 74 formed in the hanger member 64, and then threaded shank portion 70 is mated with a threaded aperture 76 formed in a recessed section 78 of the rear clamp section 62. The shoulder section 72 is proportioned such that when firmly affixed to rear clamp section 62, fastener 66 allows hanger member 64 to be slidably engaged in recess 78. The vertical movement of hanger member 64 is controlled by a positioning bolt 80, which consists of the threaded shank portion 82, enlarged head portion 84, and annular bearing surface 86. Shank portion 82 of bolt 80 is threaded through aperture 88 in a blank 90 to control the position of hanger member 64 by bearing against a slot 92 in blank 94 of rear clamp section 62 as more fully described hereinafter.

Clamp section 60 is generally U-shaped, having base 96 and arms 98 and 100. Tangs 102 and 104 are formed along the internal edges of arms 98 and 100 to space clamp section 60 from clamp section 62 upon final engagement and to allow free movement of hanger member 64 therebetween. Corner connector 58 is also provided with fastening means such as a bolt 106 which passes through aperture 108 in rear clamp section 62 and engages threaded aperture 110 in front clamp section 60 to draw said sections 60 and 62 into clamping engagement. Other bolts, not shown, pass through apertures 112, 114, and 116 in rear clamp section 62 to similarly engage threaded apertures 118, 120 and 122 in front clamp section 60.

According to the practice of the present invention, corner connector 58 secures stile 32 and rail 38 in a sturdy rectangular relationship through the interaction of tines 124–134 and protuberances 136–142 with lip 50 and groove 52 on the flange 44 formed on said stile 32 and said rail 38. The tines 124–134 are formed on front clamp section 60 and project toward the rear clamp section 62. The protuberances 136–142 are formed on rear clamp section 62 and project toward front clamp section 60. These tines and protuberances coact as more fully described in FIG. 3, and FIGS. 5–7.

Further details of the embodiment will be shown by a description of the assembly of stile 32 and rail 38. It will be understood that as the various stiles 32 and 34 and rails 36 and 38 are identical and the corner connectors are symmetric, according to the present invention, this description applies to any of the corner joints of the frame assembly.

Figure 5:
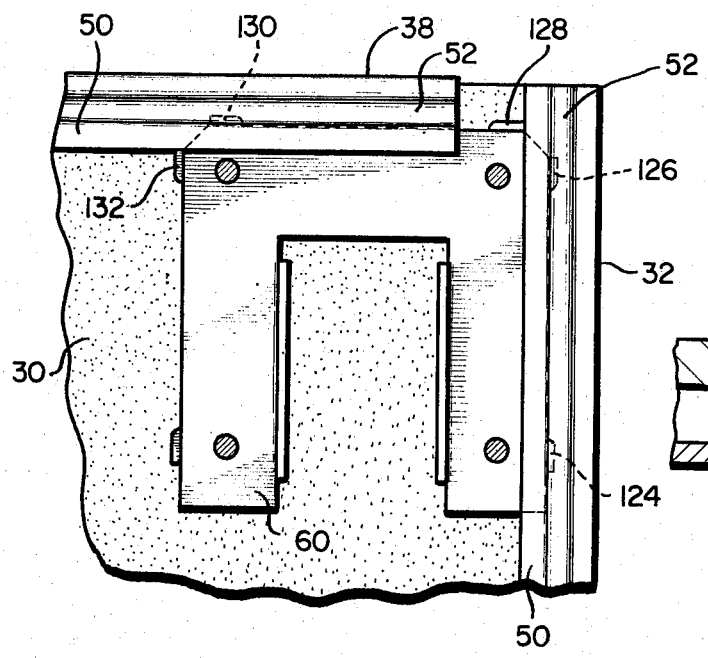
FIG. 5 is a rear elevational view of the frame section and corner connector of the present invention.

Turning to FIG. 5, stile 32 and rail 38 are shown positioned on the panel 30 as hereinbefore described. The front clamp section 60 is positioned behind panel 30 with the tines 124, 126 and 130 abutting the outer edge of the lip 50 and tines 128 and 132 abutting the inner edge thereof.

Figure 3:
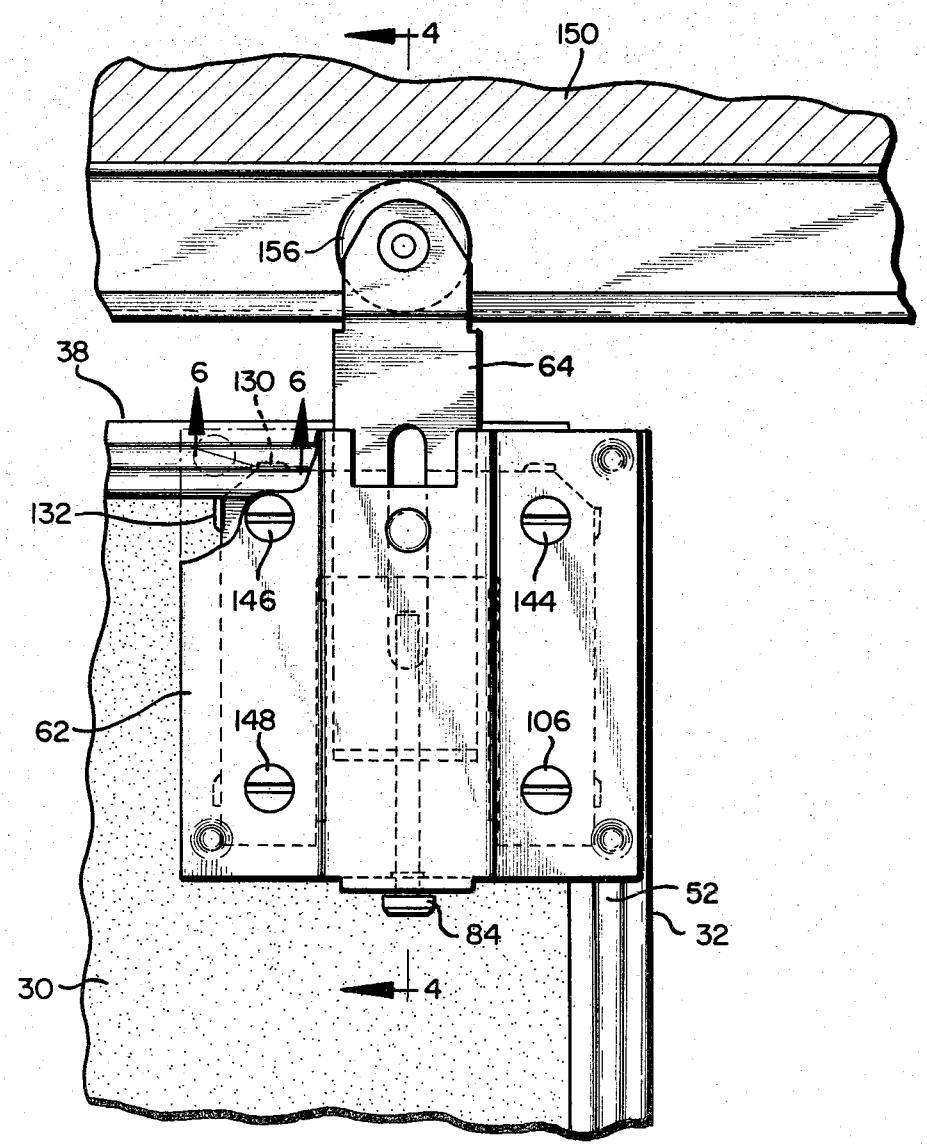
FIG. 3 is a vertical rear view, partially in section, of the corner joint of FIG. 2 as installed in use.

As is shown in FIG. 3, rear clamp section 62 is then positioned over said front clamp section and engaged thereto by means of bolts 106, 144, 146 and 148. Rear clamp section 62 is of a size to overlay the stile 32 and rail 38, with protuberances 136, 138, 140 and 142 projecting inwardly to engage the grooves 52 formed therein.

Figure 6:
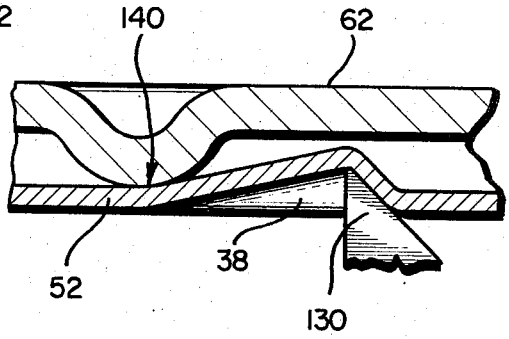
FIG. 6 is an enlarged, fragmentary sectional view taken along the line 6—6 of FIG. 3.

As the sections 60 and 62 are drawn into clamping engagement, the protuberances 136–140 of rear clamp section 62 overlay the groove 52, and the tines 124–132 abut the lip 50 of frame sections 32 and 38. As is shown in FIG. 6, complete engagement of the clamp sections 60 and 62 forces the tines 124–132, as represented by the tine 130, to indent the wall of the groove 52 of frame section 38 into a bearing relationship to the protuberance 140 of the frame section 62.

Figure 7:
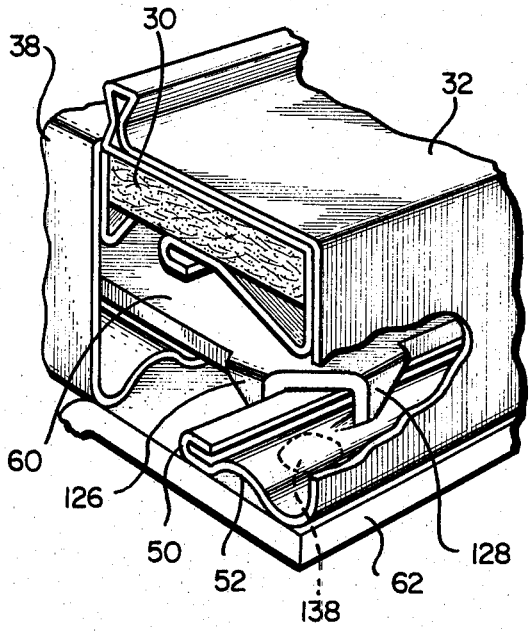
FIG. 7 is an enlarged isometric view partially in section, of the corner connector and frame sections of the invention.

As is further shown by FIG. 7, probuterance 138 fits firmly into groove 52 and is further secured by the reverse indentation of groove 52 by the tine 128 of front clamp section 60. In addition, the tines 126 and 128 are sized to tightly straddle the lip 50 of frame section 32 and to further lock the frame sections 32 and 38 in a rectangular relationship. This description as to the corner shown by FIG. 7 applies equally to the connection formed on upper rail 38 by tines 130 and 132 and protuberance 140. As is shown in FIG. 5, the lower tine 124 abuts the inner edge of lip 50, as do tines 126 and 130; and tines 128 and 132 tightly abut the outer edge of lip 50 to further contribute to the integrity of the corner connector 58. While not used in the figures here presented, it is to be understood that the tine 134 and protuberance 142 perform in a similar manner to tine 124 and protuberance 136 when the corner connector 58 is used at corners adjacent to those shown in FIG. 2.

Figure 4:
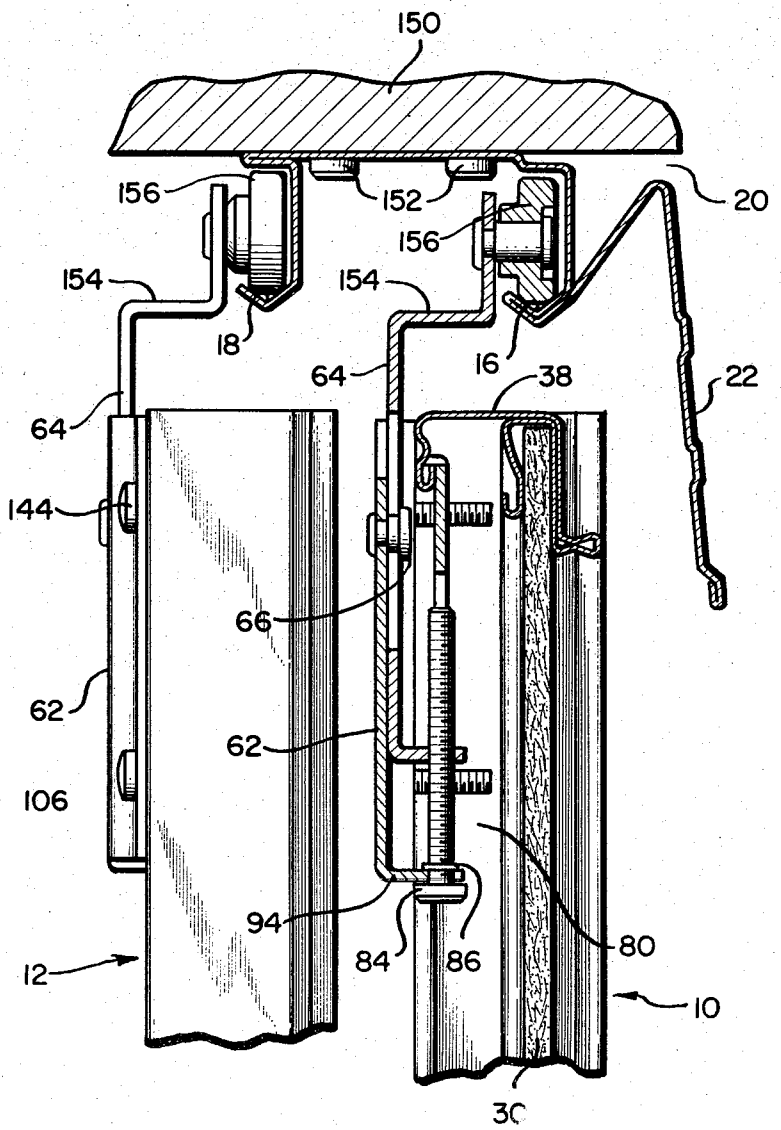
FIG. 4 is a vertical end view taken along the line 4—4 of FIG. 3, illustrating the outermost door of an assembly partially in section.

The corner connector 58 is suspended from header track 20 in a manner hereinafter described. In FIG. 4, header track 20 is attached to an overhead portion 150 of doorway 14, not shown, by means of threaded fasteners 152. The hanger member 64 is provided with an offset section 154 which allows wheel 156 to be positioned directly above the vertical center of gravity of sliding doors 10 and 12 such that said doors hang vertically from the overhead channels 16 and 18. The hanger member 64 is attached to the rear clamp section 62 of corner connector 58 by means of fastener 66 in a manner hereinbefore described.

Figure 8:
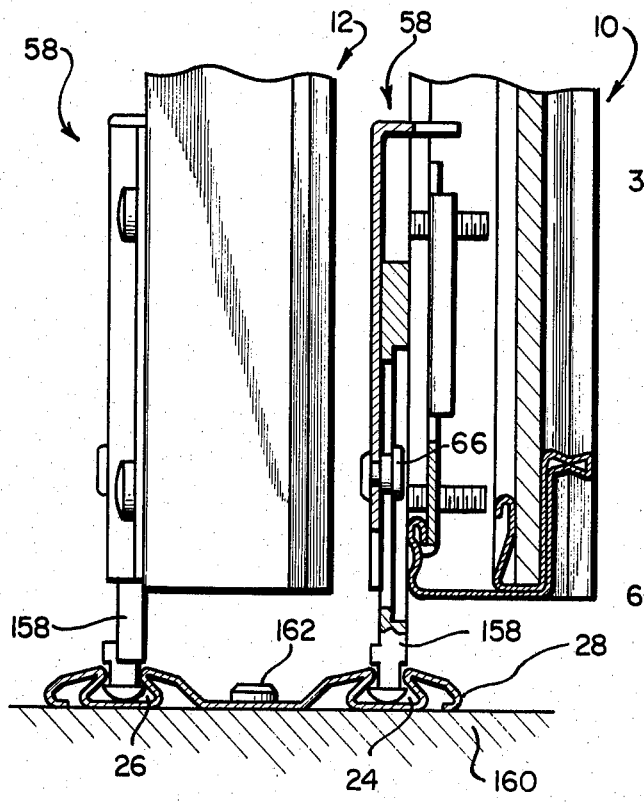
FIG. 8 is a vertical end view partially in section similar to FIG. 4, but showing the lower guide and corner connector of the invention.

Vertical adjustment of hanger member 64 relative to the corner connector 58 is accomplished by means of the bolt 80 inserted in slot 92 of tang 94 of the rear clamp section 62. The bolt 80 is provided with enlarged head portion 84 and collar 86 which hold the bolt captive relative to slot 92. Thus, vertical movement of the bolt 80 relative to the corner connector 58 is prevented and rotation of the bolt 80 produces vertical movement of hanger member 64 through the engagement of bolt 80 with threaded aperture 88 provided in the lower tang portion 90 of said hanger member. The rotation of the bolt 80 may be accomplished by a screwdriver, not shown, or other suitable means. As is shown in FIG. 8, the lower edges of doors 10 and 12 are engaged with channels 24 and 26, respectively, of sill 28 by means of a guiding member 158 which depends from the lower corner connectors of said doors. The sill 28 is attached to the floor 160 beneath doorway 14 by means of fasteners 162 disposed axially between channels 24 and 26.

The invention is claimed as follows:

1. A corner connector for use with framed sections disposed at right angles and interconnected to form a corner joint, said frame sections having a flange projecting inwardly relative to said corner joint, and having an enlarged lip along the free edge thereof, said corner connector comprising: a first clamp section; a second clamp section superposed with said first clamp section and including indenting means protruding toward said first clamp section; means for engaging said flange interjacent said first clamp section and said second clamp section; whereby said indenting means will bear against and bitingly engage said flange and span the enlarged lip thereby rigidly connecting said frame sections.

2. A corner connector as defined in claim 1 wherein said first clamp section further comprises projection means protruding toward said second clamp section.

3. A corner connector as defined in claim 1 or claim 2 wherein said second clamp section further comprises a generally U-shaped member having arms projecting inwardly relative to said corner.

4. A corner connector as defined in claim 1 or claim 2 wherein said indenting means comprise tines disposed along the edges of said second clamp section.

5. A corner connector as defined in claim 1 or claim 2 wherein said indenting and said projection means interlock through said flanges of said frame sections.

6. A corner connector according to claim 1 which further comprises hanging means adapted to slidably suspend said frame section from an overhead track.

7. A corner connector according to claim 1 wherein said indenting means comprise tines formed on said second clamp section, which second section includes opposed side edges and a top edge joining said side edges, with a pair of tines formed proximate the juncture of each side edge with the top edge, one of said pair on the top edge the other on the side edge, such that said tines will span the enlarged lip on the frame section to prevent relative lateral movement and bitingly engage said flange.

8. A corner connector according to claim 7, further including projection means on said first clamp section extending toward said second clamp section to engage said flange on a side opposite that engaged by said tines, and said projection means being disposed to cooperate with said tines to grip said flange firmly upon assembly and thereby prevent relative movement between said frame sections and said corner connector.

9. A corner joint for a frame section, said joint comprising two frame sections disposed at right angles to form a corner, each of said frame sections including at least a flange having an enlarged lip along the free edge thereof, said flanges facing inwardly relative to said corner, and a corner connector assembly for maintaining said frame sections in assembled relationship, said connector assembly comprising: a first clamp member, a second clamp member and means for drawing said clamp member into clamped engagement with the flanges on the respective frame sections to maintain said frame sections in an assembled corner joint, one of said clamp members including a plurality of indenting means projecting from the surface thereof, with indenting means spanning the enlarged lip of each said flange section and bitingly engaging said flange.

10. A corner joint according to claim 9, wherein said indenting means comprises tines formed on said clamp section, which section includes opposed side edges and a top edge joining said side edges, a pair of tines formed proximate the juncture of each said side edges with the top edge, one of said pair on the top edge, the other on the side edge, with one of said pair on each side of the enlarged lip on the adjacent frame section to prevent relative lateral movement and bitingly engage said flange.

11. A corner joint according to claim 10, wherein said other clamp section includes projection means extending toward said first mentioned clamp section to engage said flange on a side opposite that engaged by said tines, with said projection means disposed to cooperate with said tines to enhance said biting engagement.

12. A corner joint according to claims 10 wherein said side edges include additional tines for bitingly engaging said flange, with only one of said additional tines so engaged.

13. A corner joint according to claim 9, further including means for affixing said frame to an associated guide track, or the like.

* * * * *